United States Patent [19]

Symmank

[11] 4,015,730

[45] Apr. 5, 1977

[54] ADJUSTABLE BOOM FOR MATERIAL HANDLING IMPLEMENT

[75] Inventor: William D. Symmank, Schofield, Wis.

[73] Assignee: J. I. Case Company, Racine, Wis.

[22] Filed: Nov. 24, 1975

[21] Appl. No.: 634,921

[52] U.S. Cl. ..... 214/141; 212/144

[51] Int. Cl.[2] ..... E02F 3/38

[58] Field of Search ..... 214/141; 212/52, 54, 212/55, 8 R, 9, 144

[56] References Cited

UNITED STATES PATENTS

| | | | |
|---|---|---|---|
| 1,068,279 | 7/1913 | Schrader | 212/54 |
| 2,449,160 | 9/1948 | Castle | 214/141 |
| 2,538,000 | 1/1951 | Hoar et al. | 214/141 |
| 3,445,015 | 5/1969 | Sampo et al. | 214/141 |
| 3,465,904 | 9/1969 | Pensa | 214/141 |
| 3,917,094 | 11/1975 | Magneson | 212/55 |

*Primary Examiner*—Robert J. Spar
*Assistant Examiner*—Ross Weaver
*Attorney, Agent, or Firm*—Dressler, Goldsmith, Clement, Gordon & Shore, Ltd.

[57] ABSTRACT

A mobile excavator having a self-powered frame structure supporting a platform for rotation about a vertical axis with a boom pivoted on a platform and a material handling device pivoted on the free end of the boom. The boom is formed in first and second boom sections which are pivotally interconnected to each other and movable relative to each other to vary the overall length of the boom.

7 Claims, 4 Drawing Figures

ADJUSTABLE BOOM FOR MATERIAL HANDLING IMPLEMENT

BACKGROUND OF THE INVENTION

The present invention relates generally to material handling devices and more particularly to an improved boom structure for devices such as mobile excavators.

One type of known material handling device, which has been in existence for some time, includes a boom carried by a support for pivotal movement in a substantially vertical plane about a horizontal pivot axis. Generally, the support or platform is rotatable about a vertical axis on a self-powered frame structure and the boom is pivoted about the horizontal pivot axis on the platform by fluid powered means.

The free end of the boom pivotally supports a material handling unit, such as a dipper stick having a bucket pivoted thereon. The dipper stick is again pivoted relative to the free end of the boom through additional fluid power means while the bucket is pivoted on the outer end of the dipper stick through further fluid power means, such as fluid rams.

Self-powered units of this type have found a remarkable degree of commercial success. However, the construction and arrangement of the various parts in commercial machines heretofore known has placed limitations on the overall operation of the machine.

In the machines of the above-mentioned type, it is many times desirable to increase the overall length of the boom with respect to the platform to thereby increase the reach of the material handling unit with respect to the platform. Heretofore this has been accomplished in numerous different ways, such as the provision of telescopic boom sections that can be extended and retracted relative to each other to vary the effective length of the boom. While this arrangement has to some measure been satisfactory, there are certain shortcomings to such a solution. For example, in order to have telescoping boom sections, the overall weight of the boom must be substantially increased. Furthermore, utilizing telescoping boom sections for the mobile unit, results in decreasing the overall load capacity for the boom as the effective length of the boom is increased. The primary reason for such decrease in load capacity results from the overall weight of the boom sections, particularly when they are in an extended condition relative to the platform.

Another problem encountered with extending the overall length of the boom is the fact that the overall dimensions of the vehicle must be maintained within certain limmits in order for the vehicle to be transported on public highways.

While numerous alternates to the telescoping boom arrangement have been proposed, none of these have found any degree of commercial success, primarily because of the overall cost of manufacturing such units and also possibly because of the complicated arrangements that have been proposed for such units.

Thus, there remains a need for a structurally simple and compact mobile excavator which is capable of varying the effective length of the boom in a simple manner from the operator's compartment of the vehicle.

SUMMARY OF THE INVENTION

The present invention provides a simple method of varying the overall effective length of the boom for a material handling implement.

According to the present invention, a boom of a specific construction forms part of a mobile excavator that consists of a self-powered frame structure having a platform revolvable about a vertical axis thereon with the boom supported on horizontal pivot means on the platform.

The boom consists of first and second elongated boom sections with the first boom section having one extreme end pivotally suported on the horizontal pivot means and support means at the opposite extreme end of the first boom section supporting an intermediate portion of the second boom section for movement along a longitudinal axis. The longitudinal axis of the second boom section is angularly related with respect to the longitudinal axis of the first boom section and the inner end of the second boom section is connected to the platform through a rigid link of fixed length which has one end pivotally supported on an extreme end of the second boom section and its opposite end supported on a horizontal pivotal connection on the platform in close proximity to the horizontal pivot means for the boom. The two boom sections also are interconnected by power means so that the second boom section can be repositioned with respect to the outer end of the first boom section to an infinite number of operating positions.

DETAILED DESCRIPTION

Figure 1:
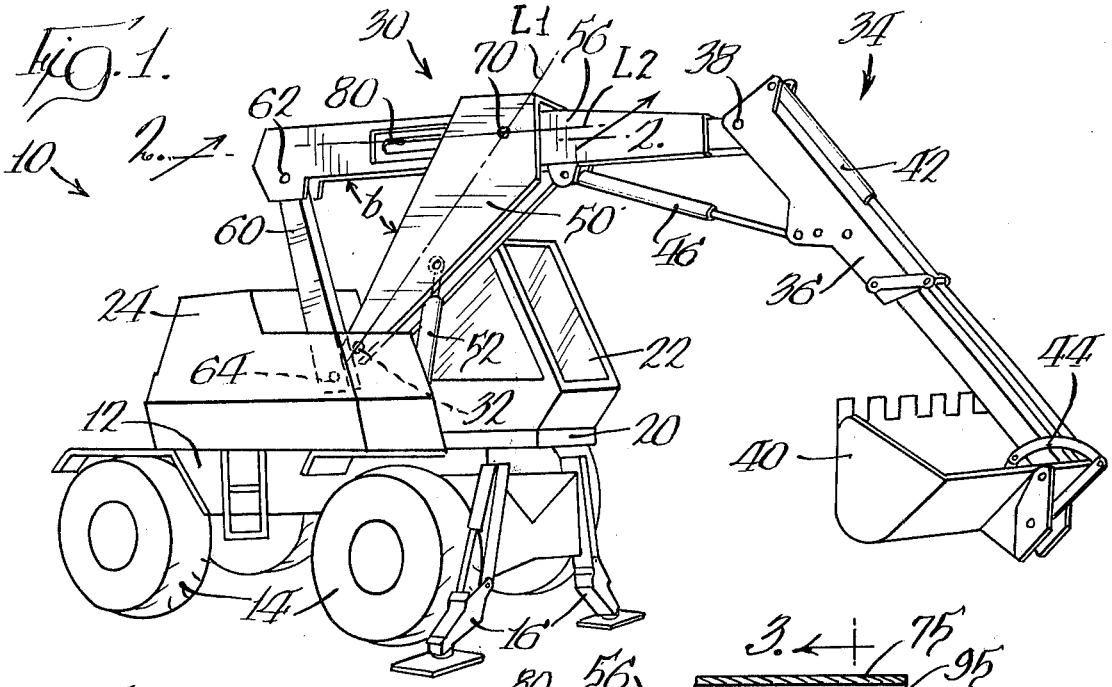
FIG. 1 shows a perspective view of the mobile excavator having the present invention incorporated therein.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

FIG. 1 of the drawings indicates a mobile excavator, generally indicated by the reference numeral 10. Mobile excavator or vehicle 10 consists of a self-powered frame structure that includes a vehicle chassis 12 supported on a plurality of driven wheels 14. Suitable outriggers 16 may be provided on the vehicle chassis 12 so that the unit can be raised sufficiently to have the wheels off the ground.

Vehicle chassis 12 has a platform or turntable 20 supported for rotation about a vertical axis with platform 20 and frame structure 12 being designed so that platform 20 can be revolved 360° with respect to the vertical axis. Platform 20 has an operator's compartment or cab 22 supported thereon and an engine compartment 24 which houses the engine and other components for powering the vehicle as well as the material handling unit to be described.

Platform 20 has a boom 30 supported at one end by horizontal pivot means 32 in close proximity to the center of the vertical axis of platform 20. Boom 30 has a material handling means 34 supported on the outer end thereof. Material handling means 34 has been illustrated as including a dipper stick 36 pivoted on the outer end of boom 30 by a pivot pin 38 with a bucket 40 pivoted on the outer end of dipper stick 36 by a fluid ram 42 and a linkage system 44. Dipper stick 36 is pivoted about pin 38 by a further fluid ram 46.

According to the present invention, boom 30 consists of a pair of boom sections that are constructed and arranged in a manner to allow the operator to vary the effective length of the boom and at the same time vary the operating characteristics of the mobile excavator. As shown in FIG. 1, boom 30 consists of a first boom section 50 that has one extreme end pivoted on horizontal pivot 32 and is movable by a fluid ram 52. The opposite end of first boom section 50 has support means 54 (FIG. 3) for supporting a second boom section 56 with the elongated axes of the two boom sections being at all times angularly related to each other. As illustrated in FIG. 1, boom section 56 is supported intermediate its opposite ends on support means 54 and is movable generally along its longitudinal axis in a manner that will be described later. Boom section 56 has material handling unit 34 supported on one end thereof while the opposite end is connected to platform 24 through a rigid link 60 having a fixed length. As illustrated, link 60 has one end pivotally supported on the inner end of hollow boom section 56 through a pivot pin 62 while the opposite end of link 60 is connected to platform 24 through a further pivot pin 64 that is located in close proximity to horizontal pivot 32, for a purpose that will be described later.

Figure 2:
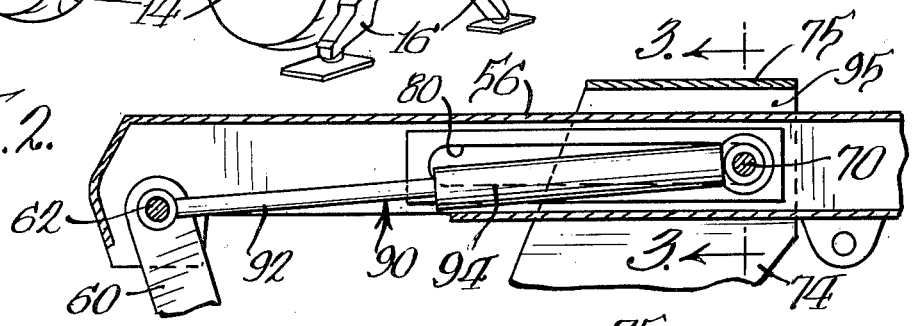
FIG. 2 is a fragmentary sectional view, as viewed along line 2—2 of FIG. 1.
Figure 4:
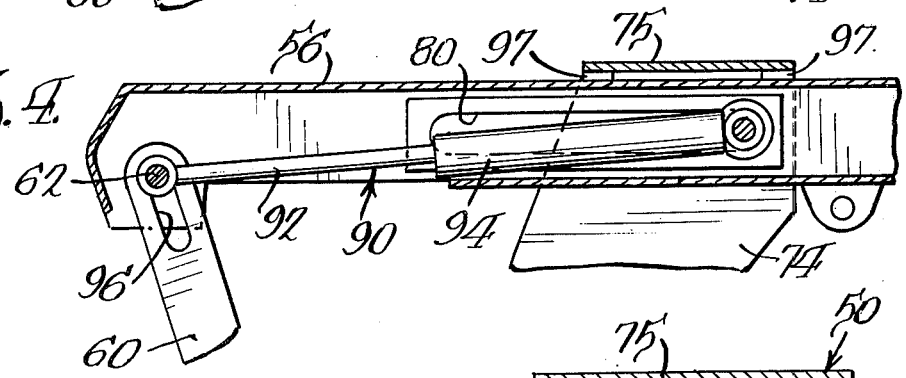
FIG. 4 is a view similar to FIG. 2 showing a modified form of construction.
Figure 3:
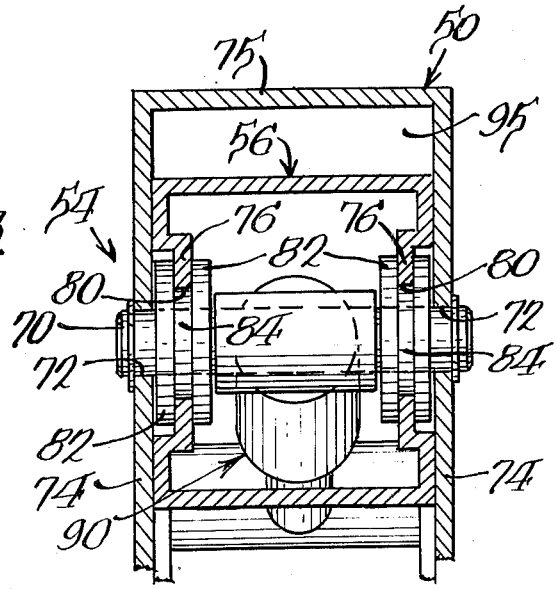
FIG. 3 is a transverse sectional view, as viewed along line 3—3 of FIG. 2.

Turning now to FIGS. 2 and 3, an illustrative type of support means 54 for supporting an intermediate portion of boom section 56 on the outer end of boom section 50 is disclosed. Support means 54 consists of a pin 70 extending through openings 72 on vertical wall portions 74 of boom section 50, which also has a horizontal top wall 75 interconnecting transversely spaced vertical walls 74. Boom section 56 is substantially rectangular in cross section and has a pair of offset portions 76 on intermediate portions of the vertical walls that form part of the hollow boom section 56. Each offset portion 76 has an elongated slot 80 therein and pin 70 extends through elongated slots 80. Pin 70 also has two pairs of spacers or collars 82 located adjacent the outer and inner surfaces of the offset portions 76. Pin 70 may also have a pair of bearing plates 84 that are slidably supported in elongated slots 80.

Boom 30 also has power means between boom sections 50 and 56 for moving boom section 56 and in the illustrative embodiment this power means consists of a fluid ram 90 located inside hollow boom section 56 and having its piston rod 92 connected to pivot pin 62 while the head end of cylinder 94 is connected to pin 70. Thus, extension and retraction of fluid ram 90 will move boom section 56 generally along its longitudinal axis with respect to support means 54.

Since rigid link 60 is of fixed length and is pivoted about pivot axis 64 during such longitudinal movement of boom section 56, provision must be made for allowing pivot pin 62 to travel along an arcuate path about pivot pin 64. This can be accomplished in two ways, one of which is illustrated in FIG. 2 of the drawings. As shown in FIG. 2, pivot pin 70 is located a sufficient distance below upper horizontal wall 75 so that a space 95 is defined between wall 75 and the horizontal wall of boom 56. Thus, boom section 56 will simultaneously be pivoted on pin 70 during the extension and retraction of boom section 56 with respect to boom section 50 and platform 20. Stated another way, the included angle b will change during relative movement of the boom sections.

An alternative arrangement for accommodating the arcuate path of travel of pivot pin 62 is to have pivot pin 62 supported in an elongated opening 96 on the outer end of link 60 so that the pin may move vertically with respect to the elongated opening or slot 96 during extension and retraction of fluid ram 90. In such an arrangement, suitable wear plates 97 may be located between the upper wall 75 of boom section 50 and the upper wall of boom section 56 and the wear plates define the sliding contact between boom section 56 and top wall 75. With the modified arrangement the included angle *b* between the two boom sections remains constant or fixed during movement of boom section 56 relative to boom section 50. Stated another way, the included angle between the longitudinal axis L1 of the first boom section and the longitudinal axis L2 remains fixed during the relative movement of the boom sections.

As can be appreciated from the above description, the unique boom construction has numerous advantages and can be constructed at a minimum cost. For example, when the boom is in the position illustrated in FIG. 1, the effective length between pivot pins 32 and 38 is at a minimum and thus, the moment arm between platform or turntable 20 and material handling unit 34 is at a minimum which means that the unit can be operated with maximum power to greatly increase the breakout force that can be applied to bucket 40. This retracted position for boom 30 also is advantageous when a loaded bucket 40 is to be moved a substantial distance since the operator has greater control over the movement of the bucket 40. If maximum breakout force is not necessary during the operation, the operator may wish to increase the speed of operation while sacrificing breakout forces. This can be accomplished by retracting fluid ram 90 to its fully retracted position which will substantially increase the effective length between pivot pins 32 and 38, increasing the overall length of the boom which means that the bucket 40 can be raised and lowered at a greater speed. Furthermore, in this position, the operator also has the maximum reach for the bucket with respect to the vehicle. Of course, the boom sections can be positioned in an infinite number of positions intermediate opposite extremes described above for certain types of operation.

While an illustrative type of support means between boom sections 50 and 56 has been shown, various other types of support means may be utilized.

What is claimed is:

1. A mobile excavator comprising a selfpowered frame structure; a platform revolvable about a vertical axis on said frame structure; a boom including a first elongated boom section; pivot means on said platform defining a horizontal pivot with one extreme end of said first boom section pivoted on said pivot means; a second elongated hollow boom section; material handling means supported on one end of said second boom section for pivotal movement about a horizontal pivot axis;

support means at the opposite extreme end of said first boom section supporting an intermediate portion of said second boom section for movement along a longitudinal axis of said second boom section; a rigid link of fixed length having one end pivotally connected to an opposite end of said second boom section by a first pivotal connection; a horizontal pivotal connection between the opposite end of said rigid link and said platform in close proximity to said pivot means; and power means between said boom sections and located within said second elongated hollow boom section for moving said second boom section relative to said support means to change the location of said one end of said second section with respect to said opposite extreme end of said first boom section.

2. A mobile excavator as defined in claim 1, in which said support means includes pin means and said hollow second boom section has elongated slot means with said pin means extending through said slot means so that said second boom section is slidably supported by said pin means on said

3. A mobile excavator as defined in claim 2, in which said opposite extreme end has a horizontal top wall and spaced vertical side walls and in which said pivot means includes a pivot pin extending between said side walls with said second boom section located between said side walls and below said top wall.

4. A mobile excavator as defined in claim 1, in which said first pivotal connection includes a pivot pin on said opposite end of said second boom section and said one end of said rigid link has an elongated opening receiving said pivot pin so that the included angle between said boom sections remains constant during the relative movement of said boom sections.

5. A mobile excavator as defined in claim 1, in which said first boom section has transversely spaced side walls with said second boom section located between said side walls and in which said support means includes pin means extending between said walls and said second boom means has elongated slots with said pin means extending through said slots.

6. A mobile excavator as defined in claim 5, in which said power means includes a fluid ram located in said hollow boom section and having relatively movable elements with one element connected to said pin means and another element connected to said first pivotal connection.

7. A mobile excavator as defined in claim 6, in which said first boom section has a top wall interconnecting said side walls and said second boom section is in sliding contact with said top wall and in which said rigid link has an elongated opening receiving said first pivotal connection so that the including angle between said boom sections remains fixed during relative movement of said boom sections.

* * * * *

UNITED STATES PATENT AND TRADEMARK OFFICE

CERTIFICATE OF CORRECTION

PATENT NO. : 4,015,730

DATED : April 5, 1977

INVENTOR(S) : William D. Symmank

It is certified that error appears in the above-identified patent and that said Letters Patent are hereby corrected as shown below:

Column 1, line 55, "limmits" should read --limits--.

Column 5, line 22, after "said" second occurrence should read --first boom section.--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*